US010895135B2

(12) United States Patent
Creamer

(10) Patent No.: US 10,895,135 B2
(45) Date of Patent: Jan. 19, 2021

(54) JET PUMP

(71) Applicant: Reginald D. Creamer, Rockyview County (CA)

(72) Inventor: Reginald D. Creamer, Rockyview County (CA)

( * ) Notice: Subject to any disclaimer, the term of this patent is extended or adjusted under 35 U.S.C. 154(b) by 118 days.

(21) Appl. No.: 16/400,160

(22) Filed: May 1, 2019

(65) Prior Publication Data

US 2019/0338623 A1 Nov. 7, 2019

Related U.S. Application Data

(60) Provisional application No. 62/665,017, filed on May 1, 2018.

(51) Int. Cl.

| | |
|---|---|
| ***E21B 43/12*** | (2006.01) |
| ***F04F 5/46*** | (2006.01) |
| ***F04F 5/10*** | (2006.01) |

(52) U.S. Cl.

CPC ..... *E21B 43/124* (2013.01); *F04F 5/10* (2013.01); *F04F 5/463* (2013.01)

(58) Field of Classification Search

CPC ... E21B 43/124; F04F 5/00; F04F 5/46; F04F 5/563; F04F 101/20

See application file for complete search history.

(56) References Cited

U.S. PATENT DOCUMENTS

| | | | | |
|---|---|---|---|---|
| 2,290,141 | A * | 7/1942 | Burt | E21B 33/124 166/312 |
| 4,390,061 | A | 6/1983 | Short | |
| 4,790,376 | A | 12/1988 | Weeks | |
| 6,453,996 | B1 | 9/2002 | Carmichael | |
| 10,309,425 | B1 * | 6/2019 | Burgess | F04F 5/54 |
| 2005/0002797 | A1 | 1/2005 | Morishima | |

FOREIGN PATENT DOCUMENTS

| | | |
|---|---|---|
| EP | 1998053 | 12/2008 |

* cited by examiner

*Primary Examiner* — Kenneth J Hansen

(74) *Attorney, Agent, or Firm* — Ryan W. Dupuis; Ade & Company Inc; Kyle R Satterthwaite

(57) ABSTRACT

A wellbore jet pump includes a nozzle body with a tapering nozzle passage therein and a pump body with a main passage that receives the nozzle body therein so as to define within the main passage (i) an intake section surrounding the nozzle body, (ii) a mixing section immediately above the nozzle body, and (iii) a diffuser section diverging upwardly from the mixing section. A bypass conduit directs a working fluid downwardly alongside the pump body and upwardly into one of the nozzle passage or the intake section so that produced fluids are drawn into the other one of the nozzle passage or the intake section for subsequent mixing of the working fluid and the produced fluid in the mixing section. In this manner both the working and produced fluids are accelerated before entering the mixing section to increase pump efficiency.

13 Claims, 7 Drawing Sheets

PRIOR ART

Return Fluid Flow
Power Fluid In
Return Fluid Flow
Deadhead Fluid Flow 9
10

JET PUMP

This application claims the benefit under 35 U.S.C. 119(e) of U.S. provisional application Ser. No. 62/665,017, filed May 1, 2018.

FIELD OF THE INVENTION

The present invention relates generally to jet pumps. More particularly the present invention relates to the use of jet pumps for fluid production in oil and gas wells and in cleaning sand from oil and gas wells.

BACKGROUND

Many oil and gas wells today are designed and drilled with horizontal sections to increase the area of the targeted formation accessed by the well. Production of these wells can present problems especially if sand is present. Sand can be produced from the formation itself or as a result of the formation fracturing process. In either case the sand can plug off the well bore and reduce or prevent oil from being produced to surface.

Different procedures are used to clean well bores and restore production rates. One system that has proven to be successful is the use of jet pumps because of their ability to produce high percentages of sand and maintain an under balanced condition in the well bore. Which means that the well bore is kept at a lower pressure than the formation while sand is cleaned from the well bore and therefore sand is not forced back into the formation during the cleaning process. The jet pump under balanced cleanout system would be much more widely used if it could be made more efficient and cost effective.

The use of jet pumps in clean out or production operations is expensive for two reasons.

The jet pump requires high pressure and velocity power fluid to be combined with well bore fluid, in a mixing tube, where the energy of both is combined and averaged. Current jet pump designs use high pressure power fluid forced through a nozzle to create a venturi gap which causes the produced fluid along with the power fluid to enter a mixing tube where the produced fluid and the power fluid are combined with enough resulting pressure to force them both to surface. (FIG. 1) Turbulence created in the mixing tube, especially when sand is being produced at the same time, causes wear in the mixing tube which can result in having to withdraw the pump, repair it, and rerun. This can be both expensive and time consuming.

Current designs of jet pumps which incorporate a venturi gap where produced fluid is introduced perpendicular to the power fluid stream do not recover the power available due to well bore pressure. The conventional venturi gap configuration allows premature break up of the power fluid stream resulting in increased turbulence, cavitation and wear as well as limiting pump output pressure.

Economical, operational and technical advantages are available.

In conventional Jet Pump designs, (FIG. 1) used to produce oil wells, power fluid is pumped through a nozzle at high pressure. The power fluid pressure and the nozzle inside diameter determine the velocity and volume of the fluid through the nozzle, therefore the kinetic energy available. Fluid exits the nozzle at high velocity and passes through a venturi gap creating a low pressure area around this high velocity flow where the fluid to be produced is introduced and both are forced into a mixing tube. The mixing tube combines and averages the input energies of the two fluids. A venturi distance of approximately the inside diameter of the nozzle is typical. In a well designed Jet Pump ⅓ of the energy available is effective in pumping. Many studies have been done to define the most efficient combination of mixing tube diameter, nozzle diameter and venturi distance.

Jet pumps are effective in many oil well pumping applications. They have a reputation for their ability to lift high percentages of sand in the produced fluid and have been used to produce wells with high sand cuts as well as perform well bore cleanouts. Coiled tubing systems with concentric tube strings (a pipe inside a pipe) have been used to deploy a jet pump system into well bores to evacuate sand. Jet pump life and efficiency prevent the wider use of these systems.

The design of Jet Pumps is simply a device to transfer kinetic energy from a supplied high velocity power fluid to a static fluid (the fluid to be produced), combining and averaging the energy therefore allowing both to be pumped (FIG. 1).

Jet pumps are kinetic energy transfer devices. The jet pump in its conventional and historic design uses a nozzle, venturi gap, a mixing tube and a diffuser. (see FIG. 1) In oil well production applications and or cleanout applications, high pressure fluid, up to 45 Mpa, is forced through the nozzle creating a high velocity stream of power fluid. This power fluid is forced across a venturi gap creating a low pressure area where the fluid to be produced is introduced to the stream. Both power fluid and produced fluid are introduced into a mixing tube, which is a cylindrical straight bore. The fluids are combined in this mixing tube causing the power fluid to transfer energy to the fluid being produced. The resulting mixed fluid is introduced into a diffuser where high velocity is transformed back to pressure and at a lower velocity, to be pumped to surface.

In this conventional design there are inherent problems as follows:

(a) Produced fluid is introduced to the venturi gap at 90 degrees to the flow of the power fluid. Since there is no velocity of produced fluid in the direction of flow the produced fluid, even though it may be at significant down hole pressure, adds no energy to the system.

(b) Since the produced fluid is introduced perpendicular to the power fluid the differential velocity between the power fluid and the produced fluid is at a maximum which causes high turbulence at the mouth of the mixing tube resulting in increased wear.

(c) Extreme turbulence at the mouth of the mixing tube is concentrated over a short distance causing high wear in this area.

(d) When hydraulic cavitation problems occur they are concentrated at the mouth of the mixing tube compounding wear problems in this area.

(e) Where sand is being introduced along with the fluid being produced, the high differential velocity between the power fluid and the sand particles forces the sand to spin at high radial velocities while at the same time forcing it toward the wall of the mixing tube causing a concentrated wear area at the mouth of the mixing tube.

(f) In the conventional Jet pump design produced fluid must be accelerated over the distance of the venturi gap to a velocity which allows it to enter the mixing tube. This requires considerable power and lowers overall efficiency.

(g) Produced fluid, having no velocity in the direction of flow, must be accelerated over the distance of the venturi gap to a velocity which allows it to enter the mixing tube. These high rates of acceleration cause the power fluid stream to break apart more quickly and results in increased wear at the mouth of the mixing tube and lower efficiencies.

(h) Back pressure in the diffuser and mixing tube cause the power fluid stream to diffuse in the venturi gap and at the mouth of the mixing tube resulting in increased turbulence and decreased efficiency.

Maximum wear in a conventional design occurs just inside the mouth of the mixing tube where turbulence, cavitation and sand erosion problems combine over a short distance.

Current Jet pump systems are inefficient and require large volumes of power fluid to be pumped. Any reduction in power fluid usage results in an economic advantage. More and more companies are concerned with environmental issues and it is a clear goal to use less.

Pump wear due to turbulence and cavitation in the mixing tube reduces pump life. In many well clean out operations pumps must be withdrawn, repaired and re-run before attaining the desired result or reaching the target depth. This obviously results in increased expense and time.

One main engineering consideration in sizing current Jet pump installations is return fluid pressure, back pressure. To keep this return pressure within the operating range of the jet pump larger diameter return tubing strings with less restriction are used. This results in a requirement for bigger more powerful equipment from coil units to pumping systems which again increases costs and limits the potential applications of the system.

Economical, operational and technical advantages are available in both production and clean out operations where jet pumps are used.

It is, therefore, desirable to provide a new design and method to improve the jet pump system for oil well production and clean out.

SUMMARY OF THE INVENTION

According to one aspect of the invention there is provided a jet pump for use with a wellbore having a tubing string therein so as to define a first passage and a second passage extending along the wellbore in which the first passage receives a working fluid pumped downwardly therethrough and the second passage receives produced fluids with the working fluid returning upwardly therethrough, the jet pump comprising:

a pump body having a main passage formed therein to extend upwardly from an inlet port at a periphery of the pump body at a bottom end of the main passage to a central outlet which is centrally located within the pump body at a top end of the main passage;

the main passage including an intake section at the bottom end of the main passage in communication with the inlet port, a mixing section extending upwardly from the intake section, and a diffuser section extending upwardly from the mixing section to the central outlet;

a nozzle body received within the pump body at a central axis of the pump body within the intake section of the main passage, the nozzle body defining a nozzle passage therein which tapers upwardly towards a nozzle opening in communication with the mixing section of the main passage thereabove;

the intake section being defined between a surrounding portion of the pump body and the nozzle body so as to extend upwardly from the inlet port up to an upper end of the intake section at the nozzle opening;

the mixing section being located above the nozzle opening so as to receive an upward flow of fluid from each of the nozzle passage and the intake section of the main passage;

the diffuser section extending upwardly while gradually increasing in cross sectional area towards the central outlet;

a bypass conduit extending alongside the main passage from a top end of the pump body to a bottom end of the pump body;

a top end of the bypass conduit arranged for communication with the first passage to receive the working fluid pumped downwardly therethrough;

a first one of the inlet port and the nozzle passage being in communication with the bottom end of the bypass conduit so as to receive the working fluid from the bypass conduit upwardly therethrough; and a second one of the inlet port and the nozzle passage being in communication externally of the wellbore to receive the produced fluids from the wellbore upwardly therethrough;

whereby the produced fluids and the working fluid are mixed in the mixing section of the main passage above the nozzle opening prior to exiting the central outlet of the pump body for returning up the second passage.

The current invention will allow reduced wear and improved efficiencies in jet pumps which are used in the production of oil and, or the cleaning of well bores.

The present invention provides a new design and improvements to a jet pump which increase efficiency, increase pump life, reduce power requirements and reduce power fluid usage, which can improve the economics of current producing wells and allow economical and practical advantages on a wider range of production applications.

The present invention provides a new design and improvements to a jet pump, which in combination with concentric coil tubing, or multi parallel pipe strings currently used to deploy jet pumps, facilitates a broad range of improvements in well clean out operations. Better pump efficiency, increase pump life, reduce power requirements and reduce power fluid usage will improve the economics and allow practical advantages on a wider range of well cleanout applications. Higher return pressures mean reduced pipe weights and sizes are required therefore allowing smaller and less expensive equipment to be used to accomplish the same objective therefore reducing cost and increasing applications.

Preferably, the mixing section includes a lower portion extending upwardly from the nozzle opening and an upper portion above the lower portion, the upper portion having a constant cross sectional area extending upwardly along a length thereof and the lower portion reducing in cross sectional area while extending upwardly above the nozzle opening such that the upper and lower portions have matching cross sectional areas at the junction thereof.

Preferably, the nozzle opening is located at a junction of the intake section and the mixing section such that a longitudinal distance between the mixing section and the nozzle opening is zero.

In one embodiment, the inlet port is in communication externally of the pump body for receiving the produced fluids therein and the bottom end of the bypass conduit is in communication with the nozzle passage, such that the working fluid is directed upwardly through the nozzle passage while the produced fluids enter the inlet port. In this instance, the nozzle passage is preferably reduced in cross sectional area up to the nozzle opening. The intake section may also be gradually reduced in cross-sectional area while extending upwardly from the inlet port up to an upper end of the intake section at the nozzle opening.

In another embodiment, the nozzle passage is in communication externally of the pump body for receiving the produced fluids therein and the bottom end of the bypass conduit is in communication with the inlet port, such that the working fluid is directed upwardly through the intake section of the main passage while the produced fluids enter the nozzle passage. In this instance, the intake section is preferably gradually reduced in cross sectional area while extending upwardly from the inlet port up to an upper end of the intake section at the nozzle opening. The nozzle passage may also include a tapering section which extends upwardly while being gradually reduced in cross sectional area at a location below the nozzle opening, and/or a constant section which extends upwardly from the tapering section to the nozzle opening having a constant cross sectional area.

In one application, the jet pump may be used with the tubing string within the wellbore in which the pump body is suspended from the tubing string and in which the tubing string defines the first passage and the second passage therein such that one of the passages is annular in shape about the other passage such that the first and second passages are coaxial with one another along a length of the tubing string.

In another application, the jet pump may be used with the tubing string within the wellbore in which the pump body is suspended from the tubing string and in which the tubing string defines the first passage and the second passage therein such that the first and second passages are parallel and alongside one another along a length of the tubing string.

In yet a further application, the jet pump may be used with the tubing string suspending the pump body thereon within the wellbore and an annular sealing packer assembly spanning an annular gap between the pump body and the wellbore to isolate an annular passage between the tubing string and the wellbore along a length of the tubing string, in which one of the first and second passages is defined within the tubing string and another one of the first and second passages is defined within said annular passage.

According to another aspect of the present invention there is provided a jet pump for connection to a bottom end of a tubing string within a wellbore to produce fluids from the wellbore in which the tubing string defines a first passage extending longitudinally there through and a second passage which is annular in shape about the first passage to extend longitudinally along the tubing string coaxially with the first passage, the jet pump comprising:

a pump body having a main passage formed therein to extend upwardly from an inlet port at a periphery of the pump body at a bottom end of the main passage to a central outlet which is centrally located within the pump body at a top end of the main passage;

the inlet port communicating externally of the pump body for receiving produced fluids therein;

the main passage including an intake section at the bottom end of the main passage in communication with the inlet port, a mixing section extending upwardly from the intake section, and a diffuser section extending upwardly from the mixing section to the central outlet;

a nozzle body received within the pump body at a central axis of the pump body within the intake section of the main passage, the nozzle body defining a nozzle passage therein which tapers upwardly towards a nozzle opening in communication with the mixing section of the main passage there above, and the nozzle passage being gradually reduced in cross sectional area up to the nozzle opening;

the intake section being defined between a surrounding portion of the pump body and the nozzle body so as to extend upwardly from the inlet port up to an upper end of the intake section at the nozzle opening;

the mixing section being located above the nozzle opening so as to receive an upward flow of fluid from each of the nozzle passage and the intake section of the main passage;

the diffuser section extending upwardly while gradually increasing in cross sectional area towards the central outlet;

a bypass conduit extending alongside the main passage from a top end of the pump body to a bottom end in communication with the nozzle passage;

the bypass conduit and the central outlet of the main passage being in communication with respective ones of the first and second passages of the tubing string such that a working fluid pumped down the bypass conduit from one of the passages of the tubing string is directed upwardly through the nozzle passage while produced fluids entering the inlet port are returned upwardly with the working fluid through the other one of the passages of the tubing string.

Preferably the intake section is gradually reduced in cross section area while extending upwardly from the inlet port up to an upper end of the intake section at the nozzle opening.

According to a further aspect of the present invention there is provided a jet pump for connection to a bottom end of a tubing string within a wellbore to produce fluids from the wellbore in which the tubing string defines a first passage extending longitudinally there through and a second passage which is annular in shape about the first passage to extend longitudinally along the tubing string coaxially with the first passage, the jet pump comprising:

a pump body having a main passage formed therein to extend upwardly from an inlet port offset radially outward from a central axis of the pump body at a bottom end of the main passage to a central outlet which is located at the central axis within the pump body at a top end of the main passage;

a bypass conduit extending alongside the main passage from a top end of the pump body to a bottom end in communication with the inlet port;

the main passage including an intake section at the bottom end of the main passage in communication with the inlet port, a mixing section extending upwardly from the intake section, and a diffuser section extending upwardly from the mixing section to the central outlet;

a nozzle body received within the pump body at the central axis of the pump body within the intake section of the main passage, the nozzle body defining a nozzle passage therein which tapers upwardly towards a nozzle opening in communication with the mixing section of the main passage there above, and the nozzle passage being in communication externally of the pump body for receiving produced fluids therein;

the intake section being defined between a surrounding portion of the pump body and the nozzle body so as to be gradually reduced in cross section area while extending upwardly from the inlet port up to an upper end of the intake section at the nozzle opening.

the mixing section being located above the nozzle opening so as to receive an upward flow of fluid from each of the nozzle passage and the intake section of the main passage;

the diffuser section extending upwardly while gradually increasing in cross sectional area towards the central outlet;

the bypass conduit and the central outlet of the main passage being in communication with respective ones of the first and second passages of the tubing string such that a working fluid pumped down the bypass conduit from one of the passages of the tubing string is directed upwardly through the intake section of the main passage while produced fluids entering the nozzle passage are returned upwardly with the working fluid through the other one of the passages of the tubing string.

Preferably the nozzle passage includes (i) a tapering section which extends upwardly while being gradually reduced in cross sectional area at a location below the nozzle opening, and (ii) a constant section which extends upwardly from the tapering section to the nozzle opening having a constant cross sectional area.

BRIEF DESCRIPTION OF THE DRAWINGS

Some embodiments of the invention will now be described in conjunction with the accompanying drawings in which:

FIGS. 7 and 8 are more detailed representations of a jet pump according to the first embodiment of FIGS. 5 and 6 in which FIG. 7 is a sectional view along the line 7-7 in FIG. 8 and FIG. 8 is a sectional view along the line 8-8 of FIG. 7.

FIGS. 9 and 10 are more detailed representations of a jet pump according to the second embodiment of FIGS. 3 and 4 in which FIG. 9 is a sectional view along the line 9-9 in FIG. 10 and FIG. 10 is a sectional view along the line 10-10 of FIG. 9.

In the drawings like characters of reference indicate corresponding parts in the different figures.

DETAILED DESCRIPTION

Figure 7:
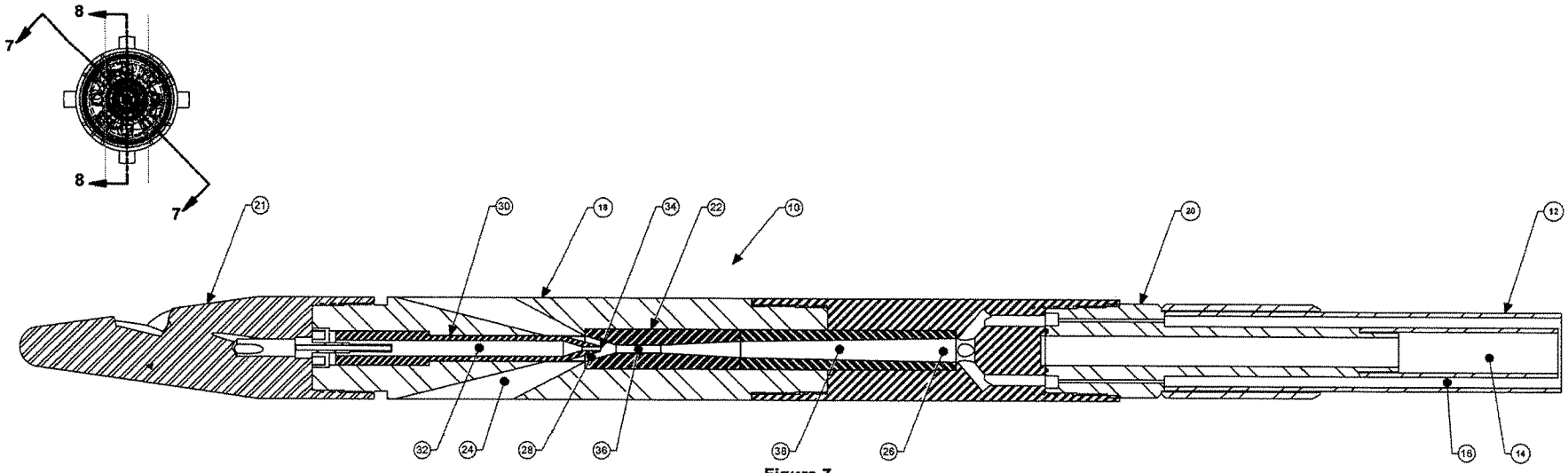
Figure 8:
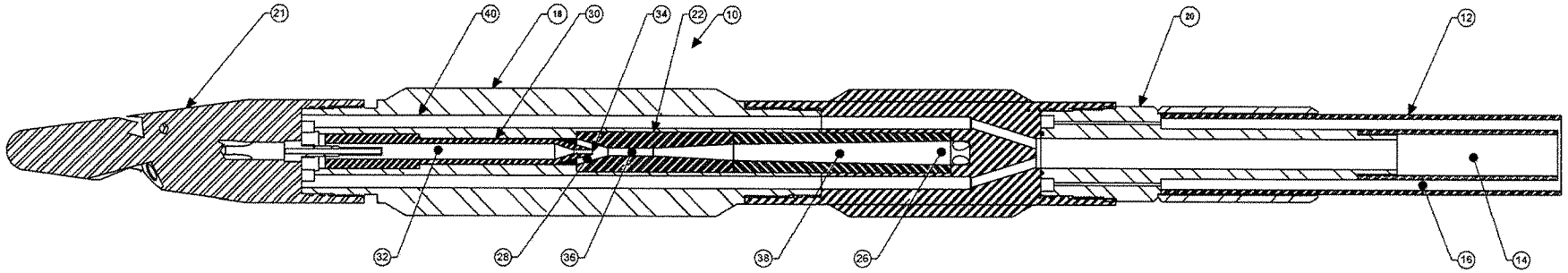

Referring initially to FIGS. 7 and 8, one exemplary embodiment of a jet pump 10 according to the present invention will first be described.

The jet pump 10 is particularly suited for use with a tubing string 12 of the type including an inner tube defining a first passage 14 along a central longitudinal axis of the tubing string which is surrounded by an outer tube that is coaxial with the inner tube so as to define an annular passage 16 surrounding the inner tube.

The jet pump 10 includes a main pump body 18 comprising an elongate tubular member formed in one or more sections to extend longitudinally between opposing top and bottom ends thereof. A coupling body 20 is attached at the top end of the pump body for connection with the tubing string 12. A bottom sub 21 encloses the bottom end of the main pump body 18.

A pump body insert 22 formed in one or more sections is supported within a longitudinal bore within the surrounding pump body to assist in defining a main passage extending longitudinally through the pump body between the top and bottom ends thereof. The main passage communicates from a plurality of inlet ports 24 at the outer periphery of the pump body adjacent the bottom end of the main passage to a central outlet 26 which is centrally located within the pump body at the top end of the main passage.

The inlet port 24 as illustrated comprises two diametrically opposed passages which communicate externally of the pump body at the bottom outer ends thereof. Four passages extend upwardly and radially inwardly towards one another from the inlet ports 24 towards the central axis of the pump body to define a lowermost intake section 28 of the main passage through the pump body.

A nozzle body 30 is supported within a central bore at the bottom end of the pump body along the central axis of the pump body. The nozzle body 30 defines a nozzle passage 32 extending axially therethrough from a bottom end to a top end of the nozzle body. The nozzle passage communicates with a nozzle opening 34 at the top end of the nozzle body. The upper end of the nozzle body 30 is located within the intake section 28 of the main passage through the pump body such that the intake section is at least partially defined between a surrounding portion of the pump body and the external surfaces of the nozzle body. The boundaries of the passages defining the intake section of the main passage extend upwardly from the external inlet ports so as to be gradually reduced in cross-sectional area while extending upwardly to the upper end of the intake section at the nozzle opening.

The main passage further includes a mixing section 36 extending upwardly from the intake section. The mixing section 36 is thus arranged to receive an upward flow of fluid from both the nozzle passage 32 and the intake section 28 of the main passage directly therebelow. A lower portion of the mixing section 36 is initially tapered inwardly to a minimum cross-sectional area of the main passage, followed by a cylindrical bore and a gradual increase in the cross-sectional area with continued upward travel along the passage to the upper end of the mixing section. More particularly, the mixing section includes the lower portion directly adjacent the intake section and extending upwardly from the nozzle opening and an upper portion above the lower portion. The upper portion has a constant cross sectional area extending upwardly along a length thereof due to its cylindrical shape. The lower portion reduces in cross sectional area while extending upwardly above the nozzle opening such that the upper and lower portions have matching cross sectional areas at the junction thereof. The nozzle opening is located at a junction of the intake section and the mixing section such that a longitudinal distance between the bottom end of the mixing section and the nozzle opening is zero.

The main passage further includes a diffuser section 38 extending upwardly from the mixing section in which the cross-sectional area of the passage continues to gradually increase with continued upward travel along the passage up to the central outlet 26 where the cross-sectional area is the greatest.

Four bypass conduits 40 extend alongside the main passage from the top end of the pump body to a bottom end of the conduits at the bottom end of the pump body where the bypass conduits communicate with the nozzle passage 32. The bypass conduits are diametrically opposed from one another in radially offset relation to the main passage along the central axis of the pump body.

The coupling body 20 and the upper end of the pump body include suitable passages formed therein for communicating the central first passage 14 of the tubing string above with the four bypass conduits 40 while coupling the central outlet 26 to the annular second passage 16 in the tubing string thereabove.

In this manner a working fluid is pumped downwardly through the first passage in the tubing string to direct the working fluid down through the bypass conduits 40 which redirects the flow upwardly through the bottom end of the nozzle passage 32 in the nozzle body. The nozzle passage includes a main portion of constant cross-sectional area followed by an upper portion where the cross-sectional area is reduced up to the nozzle opening 34 to accelerate the upward flow of the working fluid from the nozzle body into the mixing section 36 of the main passage of the pump body. Produced fluids are drawn into the inlet ports 24 at the exterior of the pump body at a location spaced downwardly from the nozzle opening of the nozzle body such that produced fluids enter the inlet ports and are communicated upwardly through the intake section 28. The cross-sectional area of the main passage through the intake section 28 is also reducing in cross section to accelerate the flow therethrough of produced fluids prior to the produced fluids mixing with the working fluid in the mixing section of the main passage directly above the nozzle body. The produced fluids and working fluid are mixed in the mixing section 36 prior to entering the diffuser section 38 for subsequent return of the produced fluids with the working fluid up through the annular second passage 16 in communication with the central outlet 26.

Figure 5:
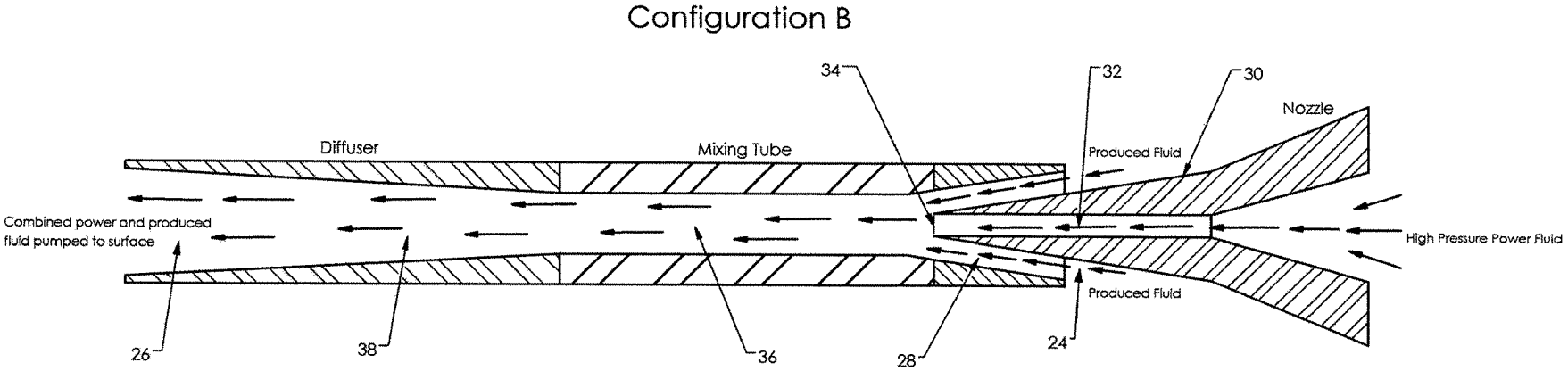
FIGS. 5 and 6 are schematic representations of a first embodiment of the jet pump according to the present invention.
Figure 6:
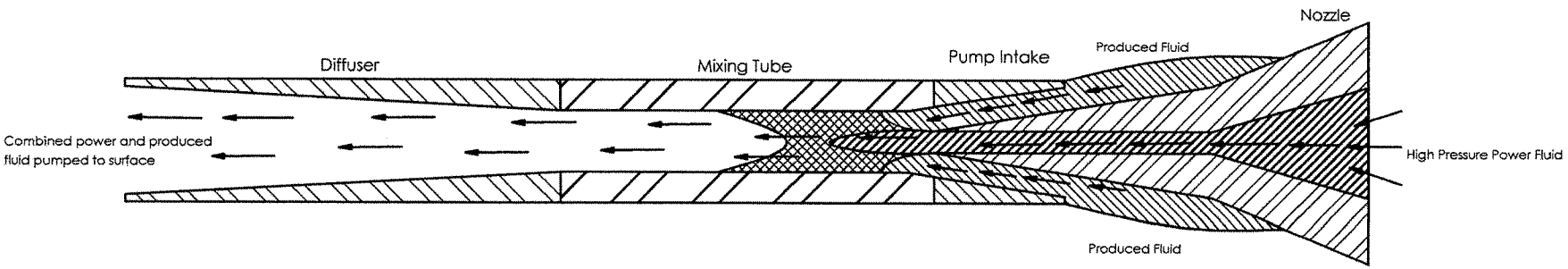

The arrangement described above is consistent with the embodiment shown in FIGS. 5 and 6 and described as configuration B below.

Figure 3:
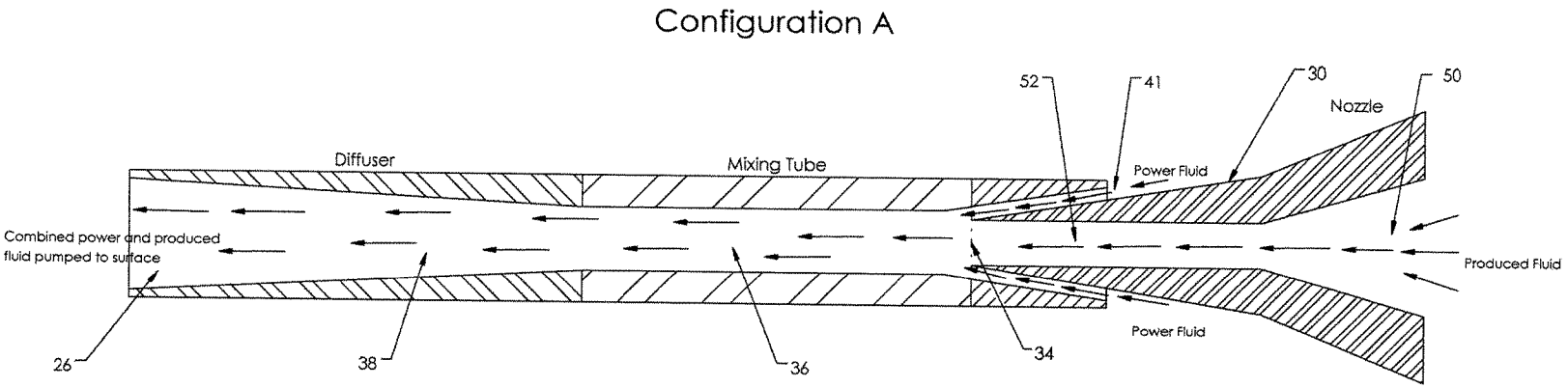
FIGS. 3 and 4 are schematic representations of the second embodiment of the jet pump according to the present invention.

In an alternative configuration A as described in relation to FIGS. 3 and 4 below, the jet pump 10 may be substantially identical to the embodiment shown in FIGS. 7 and 8, with the exception of the bypass conduits 40 being in communication with the inlet ports 24 at the bottom of the intake section 28 of the main passage such that the inlet ports 24 do not communicate externally of the pump body. In this instance, the bottom end of the nozzle passage 32 instead communicates externally of the pump body to receive produced fluids therein. In this instance, as best represented in FIG. 3, the nozzle passage may include a tapering section 50 which extends upwardly while being gradually reduced in cross-sectional area at a location spaced below the nozzle opening, and a constant section 52 which extends upwardly from the tapering section to the nozzle opening having a constant cross-sectional area along the length thereof. In this instance, the working fluid is pumped downwardly through the first passage in the tubing string to direct the working fluid down through the bypass conduits 40 which redirects the flow upwardly through the inlet ports 24 at the bottom end of the intake section 28 of the main passage. Produced fluids in this instance are drawn into the bottom end of the nozzle passage from the exterior of the pump body at a location spaced downwardly from the intake section of the main passage such that the produced fluids are communicated upwardly through the nozzle passage for mixing with the working fluid in the mixing section directly above the nozzle body. Subsequent to mixing, the produced fluids and the working fluid continue to rise upwardly together through the diffuser section for subsequent return of the produced fluids with the working fluid up through the annular second passage 16 that communicates with the central outlet 26 of the main passage through the pump body.

Figures 9, 10:
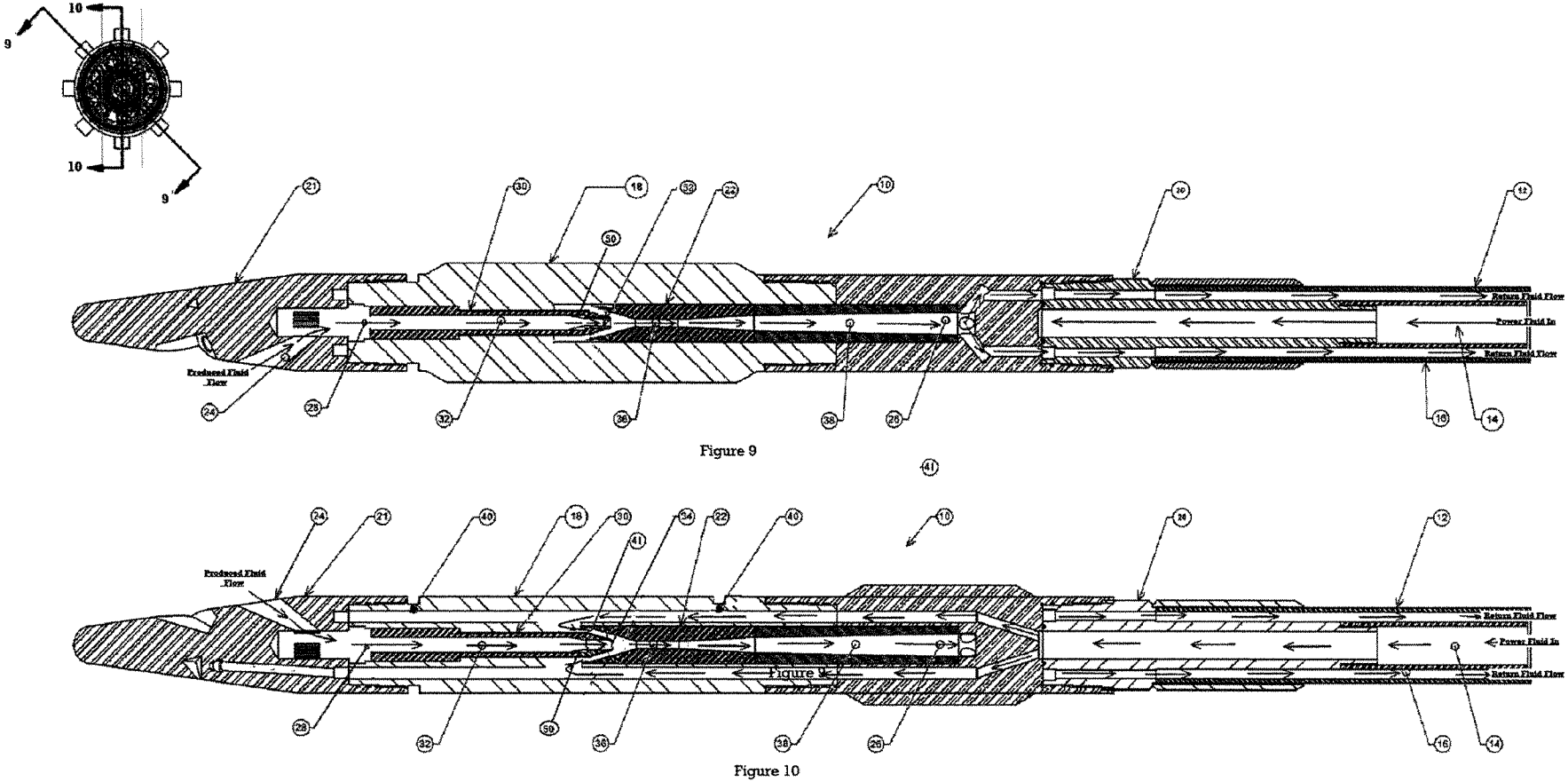

Referring now to FIGS. 9 and 10, the embodiment of a jet pump 10 according to the to the alternative configuration A, consistent with FIGS. 3 and 4, will now be described in greater detail.

The jet pump 10 is particularly suited for use with a tubing string 12 of the type including an inner tube defining a first passage 14 along a central longitudinal axis of the tubing string which is surrounded by an outer tube that is coaxial with the inner tube so as to define an annular passage 16 surrounding the inner tube.

The jet pump 10 includes a main pump body 18 comprising an elongate tubular member formed in one or more sections to extend longitudinally between opposing top and bottom ends thereof. A coupling body 20 is attached at the top end of the pump body for connection with the tubing string 12. A bottom sub 21 encloses the bottom end of the main pump body 18.

A pump body insert 22 formed in one or more sections is supported within a longitudinal bore within the surrounding pump body to assist in defining a main passage extending longitudinally through the pump body between the top and bottom ends thereof. The main passage communicates from a plurality of inlet ports 24 at the outer periphery of the bottom sub 21 adjacent the bottom end of the main passage to a central outlet 26 which is centrally located within the pump body at the top end of the main passage.

The inlet port 24 as illustrated comprises four circumferentially spaced apart passages which communicate externally of the pump body at the bottom outer ends thereof. The four passages extend upwardly and radially inwardly towards one another from the inlet ports 24 towards the central axis of the pump body to define a lowermost intake section 28 of the main passage through the pump body.

A nozzle body 30 is supported within a central bore at the bottom end of the pump body along the central axis of the pump body. The nozzle body 30 defines a nozzle passage 32 extending axially therethrough from a bottom end to a top end of the nozzle body. The nozzle passage communicates with a nozzle opening 34 at the top end of the nozzle body. The upper end of the nozzle body 30 is located within the power fluid inlet 41 of the main passage through the pump body such that the power fluid inlet section is at least partially defined between a surrounding portion of the pump body and the external surfaces of the nozzle body. The boundaries of the passages defining the power fluid section of the main passage extend upwardly from the power fluid conduits 40 so as to be gradually reduced in cross-sectional area while extending upwardly to the upper end of the power fluid section at the nozzle opening.

The main passage further includes a mixing section 36 extending upwardly from the intake section. The mixing section 36 is thus arranged to receive an upward flow of fluid from both the nozzle passage 32 and the power fluid section of the main passage 41. A lower portion of the mixing section 36 is initially tapered inwardly to a minimum cross-sectional area of the main passage, followed by a cylindrical bore and a gradual increase in the cross-sectional area with continued upward travel along the passage to the upper end of the mixing section.

The main passage further includes a diffuser section 38 extending upwardly from the mixing section in which the cross-sectional area of the passage continues to gradually increase with continued upward travel along the passage up to the central outlet 26 where the cross-sectional area is the greatest.

Four bypass conduits 40 extend alongside the main passage from the top end of the pump body to a bottom end of the conduits at the bottom end of the pump body. The bypass conduits communicate at the bottom end of the mixing section through ports 41. The bypass conduits are diametrically opposed from one another in radially offset relation to the main passage along the central axis of the pump body.

The coupling body 20 and the upper end of the pump body include suitable passages formed therein for communicating the central first passage 14 of the tubing string above with the four bypass conduits 40 while coupling the central outlet 26 to the annular second passage in the tubing string thereabove.

In this manner a working fluid is pumped downwardly through the first passage in the tubing string to direct the working fluid down through the bypass conduits 40 which redirects the flow upwardly through the bottom end of the mixing section at ports 41. The power fluid passage includes a main portion of constant cross-sectional area followed by an upper portion where the cross-sectional area is reduced up to a point perpendicular to the nozzle opening to accelerate the upward flow of the working fluid from the bypass conduits into the mixing section of the main passage of the pump body. Produced fluids are drawn into the inlet ports at the exterior of the bottom sub 21 at a location spaced downwardly from the nozzle passage of the nozzle body such that produced fluids enter the inlet ports and are communicated upwardly through the nozzle section 32. The cross-sectional area of the main passage through the nozzle section is also reducing in cross section to accelerate the flow therethrough of produced fluids prior to the produced fluids mixing with the working fluid in the mixing section of the main passage directly above the nozzle body. The produced fluids and working fluid are mixed in the mixing section prior to entering the diffuser section for subsequent return of the produced fluids with the working fluid up through the annular second passage 16 in communication with the central outlet 26.

Figure 11:
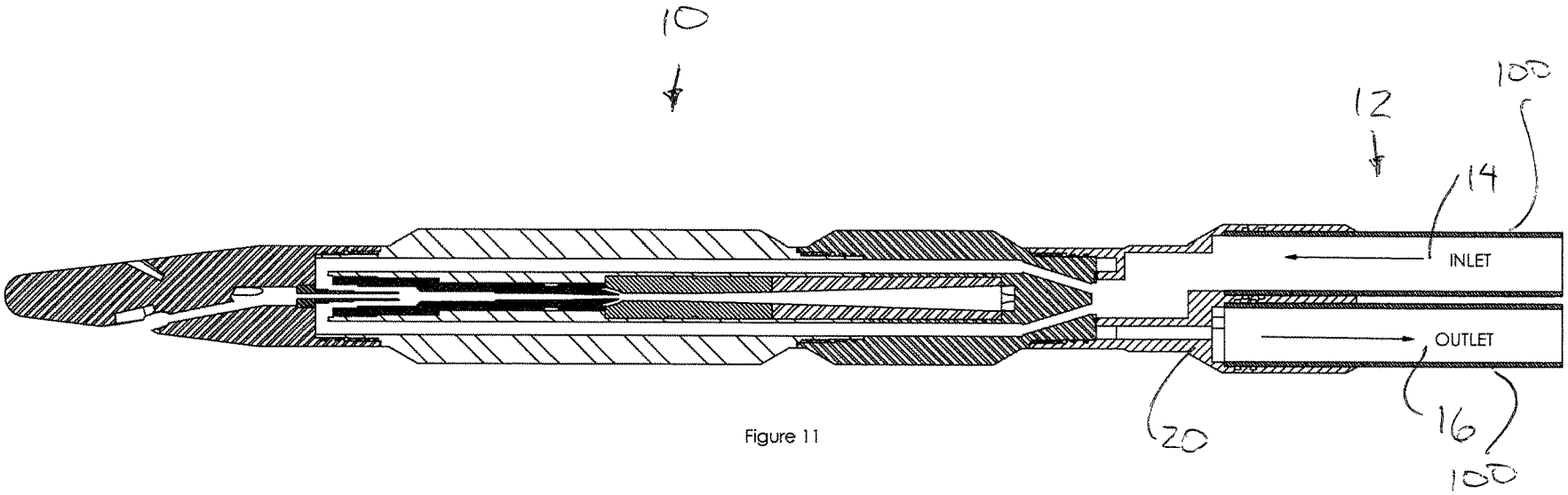
FIGS. 11 and 12 are representations of a jet pump showing a deployment system using multiple parallel pipe strings.
Figure 12:
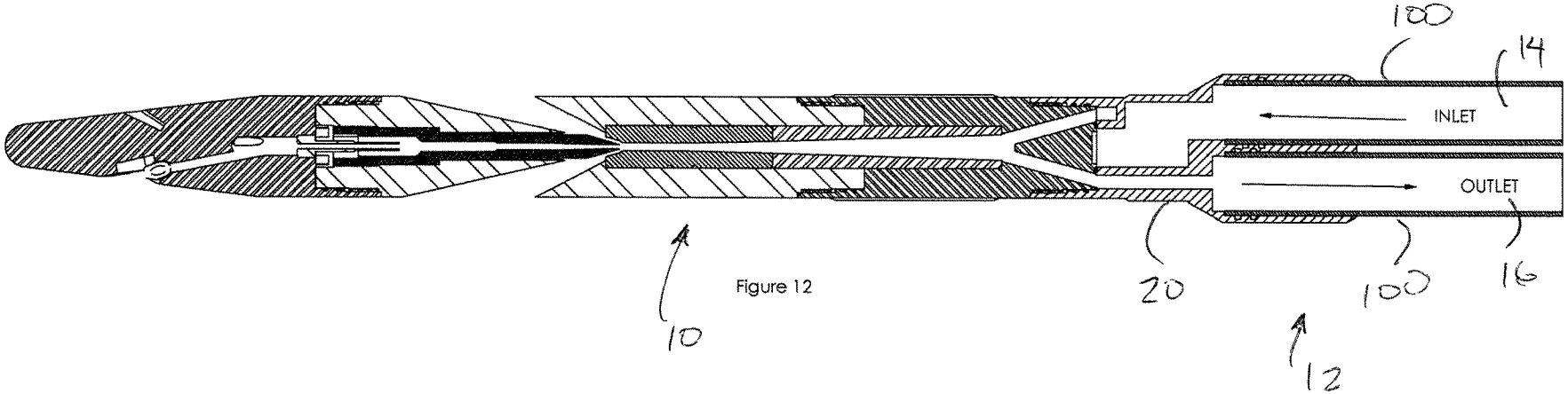

Turning now to FIGS. 11 and 12, a further embodiment of the jet pump 10 will now be described for use with a tubing string 12 which suspends the jet pump 10 therefrom within a wellbore similarly to the previous embodiment, but in which the tubing string comprises a pair of tubular members 100 which are mounted parallel and alongside one another to define the first passage 14 and the second passage 16 within the tubular members respectively. The tubing members 100 may be integrally joined with one another along the length thereof, or may be coupled to one another using suitable connectors at longitudinally spaced positions along the tubing string, or may be deployed from separate and independent coiled tubing units alongside one another for deployment into the wellbore. The jet pump 10 is substantially identical to the jet pump described according to the embodiment of FIGS. 7 and 8 with the exception of the coupling body 20 at the top end of the jet pump. In this embodiment the coupling body 20 is instead configured such that the first passage 14 from one of the tubes communicates with the bypass conduit supplying a working fluid pumped downwardly through the first passage and into the nozzle, while the second passage 16 communicates with suitable passages through the coupling body 20 to the central outlet 26 of the main passage of the jet pump to receive the mixed working fluid and produced fluids upwardly through the second passage to the wellhead.

According to a further embodiment, the jet pump according to FIGS. 9 and 10 may also be modified with a different coupling body 20 capable of connecting to a tubing string comprised of two parallel tubes 100 as described above such that the first passage 14 receiving the working fluid pumped downwardly therethrough communicates with the inlet ports at the bottom of the intake section while the other tubular member defining the second passage 16 therein communicates with suitable passages through the coupling body to the central outlet 26 of the main passage of the jet pump to receive the mixed working fluid and produced fluids upwardly through the second passage to the wellhead.

Figure 13:
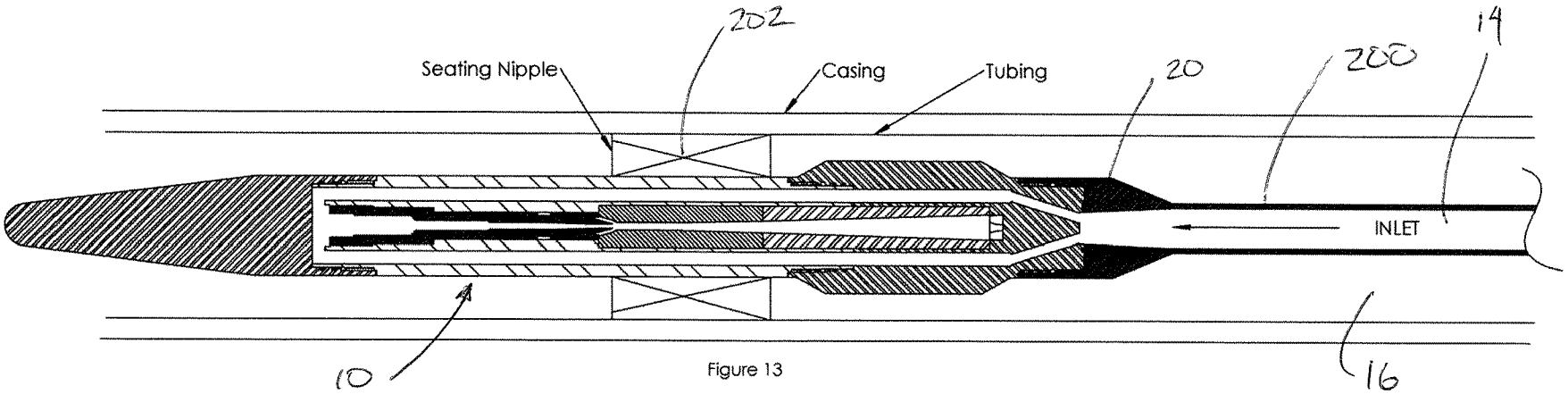
FIGS. 13 and 14 are representations of a jet pump showing a deployment system using a single pipe in conjunction with a sealing packer for production applications.
Figure 14:
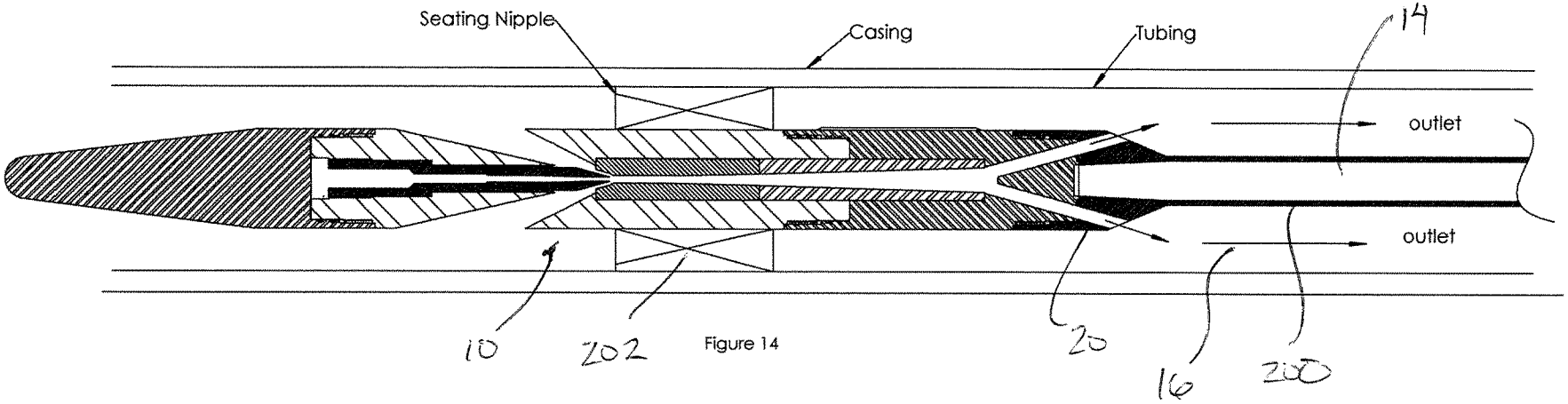

Turning now to FIGS. 13 and 14, a further embodiment of the jet pump 10 will now be described for use with a tubing string 12 which suspends the jet pump 10 therefrom within a wellbore similarly to the previous embodiments, but in which the tubing string comprises a single tubular member 200 extending longitudinally between the wellhead at the top end thereof and the jet pump suspended on the bottom end thereof. In this instance, the tubing string 12 is used together with an annular sealing packer assembly 202 which surrounds the pump body at a location spaced above the inlet ports of the intake section 28 such that the packer assembly fully spans the radial distance between the jet pump body and the surrounding casing of the wellbore to fully close off the annular gap between the jet pump body and the wellbore casing. The packer assembly 202 provides a seal preventing communication of fluid longitudinally along the annular space between the jet pump and/or tubing string and the surrounding wellbore casing at the location of the packer assembly. In this manner, the annular gap surrounding the tubing string between the wellhead and the packer assembly at the jet pump is isolated from the remainder of the wellbore therebelow so as to effectively define an annular passage between the tubing string and the wellbore casing. In this instance the interior of the single tubular member 200 defines the first passage 14 while the annular space which is isolated between the tubing string in the surrounding wellbore casing defines an annular shaped second passage 16 coaxially receiving the first passage therein along the full length of the tubing string. The coupling body 20 of the jet pump in this instance includes suitable passages formed therein so as to enable communication of the first passage within the tubing string with the bypass conduits which direct the working fluid upwardly through the nozzle, while the surrounding second passage 16 communicates with the central outlet 26 of the main body 18 to receive the returning working fluid with the produced fluids which return upwardly through the second passage to the wellhead.

According to yet a further embodiment of the present invention, the jet pump according to FIGS. 9 and 10 may also be modified with a different coupling body 20 capable of connecting to a tubing string used with a packing assembly 200 such that the tubing string defines the first passage 14 therein while the isolated portion between the tubing string and the wellbore casing defines the second passage. In this modified version of the jet pump according to FIGS. 9 and 10, suitable passages within the coupling body permit a working fluid pumped downwardly through the first passage 14 within the tubing string to enter the inlet ports of the intake section.

According to yet further embodiments of the present invention, the jet pump may be used with a tubing string 200 and packing assembly 202 according to FIGS. 13 and 14, but with a modified coupling body which instead communicates the passage within the tubing string 12 with the central outlet while the surrounding annular passage communicates with one of the inlet ports 24 or the nozzle passage so that the returning working fluid and produced fluids are returned up the passage within the interior of the tubing string 200, but the working fluid is pumped down the annular passage about the tubing string.

Many studies have been conducted to determine the most effective and efficient way to configure jet pumps in their current, conventional design however the basic technical problems have remained unresolved.

This invention provides solutions to these inherent problems and an improved economical alternative with wider applications to current jet pump designs.

In the current invention (configuration A) the venturi distance, that is the longitudinal distance from the nozzle opening to the bottom of the mixing section is reduced to zero and the power fluid is introduced where normally the produced fluid would flow. (FIG. 3)

The gap between the pump intake and the nozzle is reduced therefore reducing the cross sectional area. The area of this opening and the pressure of the power fluid determine the velocity and volume of power fluid through this opening, therefore the kinetic energy available. The high velocity power fluid causes a low pressure area at the centre line of the mixing tube. (FIG. 4) In this configuration the nozzle area is increased to allow produced fluid to enter the mixing tube.

Produced fluid is accelerated in the direction of work therefore adding energy due to the well bore pressure. The velocity of produced fluid is increased through the nozzle as area decreases in accordance with a venturi principal. The differential velocity between the produced fluid and the power fluid is reduced to a minimum at the mouth of the mixing tube. The mixing tube is tapered at the mouth to allow entry of the power fluid and produced fluid at these design velocities, therefore volume. Since the flow of produced fluid is centered in the mixing tube, at increased velocity, and power fluid is contained by the wall of the mixing tube the power fluid stream remains intact over a longer distance than in a conventional design. There is reduced cavitation, turbulence and sand erosion at the wall of the mixing tube therefore reduced mixing tube wear. The reduction of differential velocity between the power fluid and the produced fluid means improved flow of the power fluid, better energy transfer, higher output pressure and higher output volume therefore increased efficiency.

Figure 4:
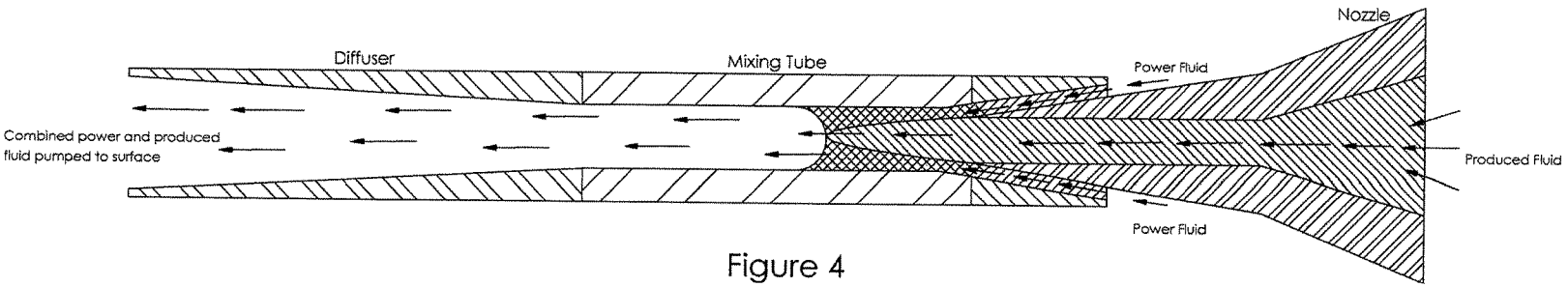

The current invention (in configuration A) allows for changes to the flow pattern by reversing the inlets for power fluid and produced fluid as shown in (FIG. 4). The advantages of this new design are:

(a) Produced fluid is introduced to the mixing tube in the direction of flow therefore adding energy to the system.

(b) Since the produced fluid is introduced to the power fluid at higher velocity and in the direction of flow the differential velocity between the power fluid and the produced fluid is at a minimum which decreases turbulence in the mixing tube resulting in improved wear characteristics.

(c) Since the produced fluid is introduced to the power fluid at higher velocity and in the direction of flow the differential velocity between the power fluid and the produced fluid is at a minimum allowing the power fluid stream to remain intact over a longer distance therefore reducing wear at the mouth of the mixing tube.

(d) Since the produced fluid is introduced to the power fluid at higher velocity and in the direction of flow the differential velocity between the power fluid and the produced fluid is at a minimum allowing the power fluid stream to transfer energy to the produced fluid over a longer distance therefore time interval which reduces cavitation wear.

(e) Since the produced fluid is introduced to the power fluid at higher velocity and in the direction of flow the differential velocity between the power fluid and the produced fluid is at a minimum. If sand is present in the produced fluid this reduced differential velocity at the boundary layer of the 2 fluids means that sand particles spin at reduced radial velocity and are forced to the centre of the mixing tube at a reduced angle therefore reducing wear due to erosion.

(f) Since the produced fluid is introduced to the power fluid at higher velocity and in the direction of flow the differential velocity between the power fluid and the produced fluid is at a minimum which decreases turbulence in the mixing tube resulting in better efficiency.

(g) Since the produced fluid is introduced to the power fluid at higher velocity and in the direction of flow the differential velocity between the power fluid and the produced fluid is at a minimum, and the power fluid is contained by the wall of the mixing tube the power fluid stream remains intact over a longer distance resulting in reduced turbulence and better efficiency.

(h) Since the produced fluid is introduced to the power fluid at higher velocity and in the direction of flow the differential velocity between the power fluid and the produced fluid is at a minimum, and the power fluid is contained by the wall of the mixing tube causing the power fluid stream to remain intact over a longer distance which allows higher back pressures in the diffuser without increasing produced fluid pressure, therefore increased efficiency.

Alternately in the current invention (configuration B) the venturi distance is reduced to zero. A pump intake is used to align the flow of the produced fluid. Produced fluid is accelerated in the direction of work therefore adding energy due to the well bore pressure. The velocity of produced fluid is increased through the pump intake as area decreases meaning that the differential velocities between the produced fluid and the power fluid is reduced to a minimum at the mouth of the mixing tube. The mixing tube is tapered at the mouth to allow entry of the produced fluid at this velocity therefore volume. Since the flow of produced fluid is contained by the wall of the mixing tube and at increased velocity the power fluid stream remains intact over a longer distance than in a conventional design. (FIG. 5)

The result is reduced cavitation and turbulence in the mixing tube, reduced mixing tube wear, improved flow of the power fluid, better energy transfer, higher output pressure and higher output volume therefore increased efficiency. (FIG. 6)

In this configuration (B), produced fluid is introduced to the mixing tube in the direction of flow therefore adding energy to the system. Since the produced fluid is introduced to the power fluid at higher velocity and in the direction of flow the differential velocity between the power fluid and the produced fluid is at a minimum which decreases turbulence in the mixing tube resulting in improved wear characteristics.

Since the produced fluid is introduced to the power fluid at higher velocity and in the direction of flow the differential velocity between the power fluid and the produced fluid is at a minimum allowing the power fluid stream to remain intact over a longer distance therefore reducing wear at the mouth of the mixing tube and increasing efficiency.

Since the produced fluid is introduced to the power fluid at higher velocity and in the direction of flow the differential velocity between the power fluid and the produced fluid is at a minimum allowing the power fluid stream to transfer energy to the produced fluid over a longer distance therefore time interval which reduces cavitation wear.

Since the produced fluid is introduced to the power fluid at higher velocity and in the direction of flow the differential velocity between the power fluid and the produced fluid is at a minimum. If sand is present in the produced fluid this reduced differential velocity at the boundary layer of the 2 fluids means that sand particles spin at reduced radial velocity and are forced to the wall of the mixing tube at a reduced angle therefore reducing wear.

Since the produced fluid is introduced to the power fluid at higher velocity and in the direction of flow the differential velocity between the power fluid and the produced fluid is at a minimum which decreases turbulence in the mixing tube resulting in better efficiency.

Since the produced fluid is introduced to the power fluid at higher velocity and in the direction of flow the differential velocity between the power fluid and the produced fluid is at a minimum. The produced fluid is contained by the wall of the mixing tube and the power fluid stream remains intact over a longer distance resulting in lower turbulence and better efficiency.

Since the produced fluid is introduced to the power fluid at higher velocity and in the direction of flow the differential velocity between the power fluid and the produced fluid is at a minimum. The produced fluid is contained by the wall of the mixing tube and the power fluid stream remains intact over a longer distance allowing higher pressures in the diffuser therefore increased efficiency.

In summary, we are offering a description of a system to improve Jet Pumps as they are used in the recovery of oil from oil wells. Configuration B (FIGS. 5 & 6) show a modification to the relative position of the high pressure nozzle and the mixing tube in a Jet Pump as well as a modification to the internal bore of the mixing tube. These changes make significant difference to the flow characteristics of a Jet Pump and we believe that these changes make the system patentable. Configuration A (FIGS. 3 & 4) show a modification to the flow pattern of a jet pump by reversing the power fluid and produced fluid inlets. This change is in addition to the changes described in Configuration B. These changes make significant difference to the flow characteristics of a Jet Pump and we believe that these changes make the system patentable.

In considering the operation of a Jet Pump and how fluid is drawn into the mixing tube, only considering a Venturi Effect does not offer a complete explanation and understanding of the condition. The over riding factor known as Choked Flow must be considered.

Choked flow is defined by Wikipedia as follows. "Choked flow is a compressible flow effect. The parameter that becomes "choked" or "limited" is the fluid velocity. Choked flow is a fluid dynamic condition associated with the Venturi effect. When a flowing fluid at a given pressure and temperature passes through a restriction (such as the throat of a convergent-divergent nozzle or a valve in a pipe) into a lower pressure environment the fluid velocity increases. At initially subsonic upstream conditions, the conservation of mass principle requires the fluid velocity to increase as it flows through the smaller cross-sectional area of the restriction. At the same time, the Venturi effect causes the static pressure, and therefore the density, to decrease downstream beyond the restriction. Choked flow is a limiting condition where the mass flow will not increase with a further decrease in the downstream pressure environment while upstream pressure is fixed. If the fluid is a liquid, a different type of limiting condition (also known as choked flow) occurs when the Venturi effect acting on the liquid flow through the restriction causes a decrease of the liquid pressure beyond the restriction to below that of the liquid's vapor pressure at the prevailing liquid temperature. At that point, the liquid will partially flash into bubbles of vapor and the subsequent collapse of the bubbles causes cavitation. Cavitation is quite noisy and can be sufficiently violent to physically damage valves, pipes and associated equipment. In effect, the vapor bubble formation in the restriction prevents the flow from increasing any further."

Figure 1:
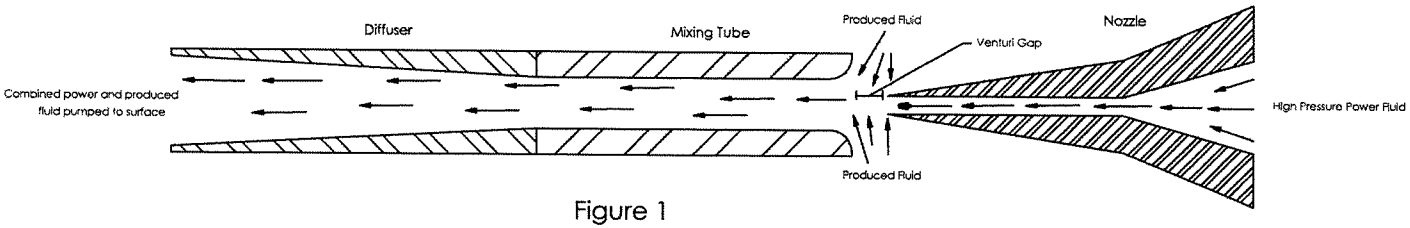
Figure 1 PRIOR ART
FIG. 1 is a schematic representation of a prior art jet pump for use in producing hydrocarbons from a well.
Figure 2:
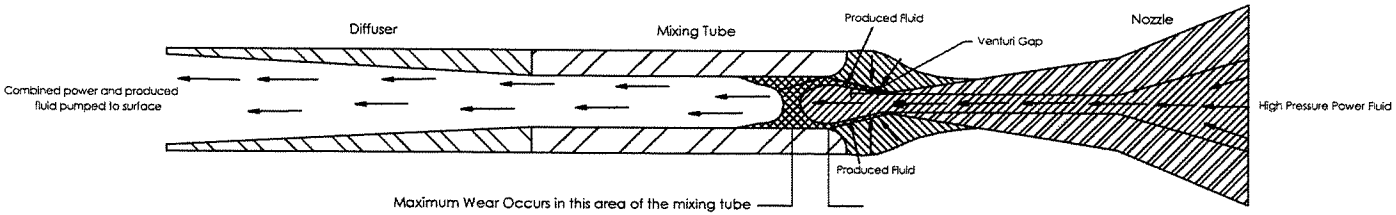
FIG. 2 is a more detailed schematic representation of the jet pump according to FIG. 1.

The design of Jet Pumps is simply a device to transfer kinetic energy from a supplied high velocity power fluid to a static fluid (the fluid to be produced), combining and averaging the energy therefore allowing both to be pumped. (FIG. 1)

The jet pump in its conventional and historic design is described as using a nozzle, venturi gap, a mixing tube and a diffuser. (see FIG. 1) In oil well production applications and or cleanout applications, high pressure fluid, up to 45 Mpa, is forced through the nozzle creating a high velocity stream of power fluid. This power fluid is forced across a venturi gap creating a low pressure area where the fluid to be produced is introduced to the stream. Both power fluid and produced fluid are introduced into a mixing tube, which is a cylindrical straight bore. The fluids are combined in this mixing tube causing the power fluid to transfer energy to the fluid being produced. The resulting mixed fluid is introduced into a diffuser where high velocity is transformed back to pressure and at a lower velocity, to be pumped to surface.

In considering the above diagram (FIG. 1) and understanding that the area defined as a venture gap is in fact the exhaust area of Chocked Flow, it is obvious to expect high turbulence, sand erosion, cavitation and wear just inside the mouth of the mixing tube. It is also obvious that increasing back pressure in the mixing tube will break the power fluid stream apart much more quickly resulting in reduced intake flow of the produced fluid.

To address these problems, it is desirable to maintain the jet stream of high velocity power fluid for as long as possible and as far into the mixing tube as possible.

To accomplish this (see FIG. 5, 6): (i) The distance defined in (FIG. 1) as a venture gap is reduced to zero. (ii) Static pressure of the produced fluid is used to increase the velocity of the fluid being produced in the direction of mixing tube flow, reducing the velocity differential between produced fluid and power fluid. (iii) The mouth of the mixing tube is increased in area and the mixing tube entrance is tapered to allow produced fluid to enter as dictated by the down hole pressure, desired production rate, nozzle diameter and power fluid velocity in a particular application. (iv) Fluid is contained in the mixing tube by the wall of the mixing tube therefore not allowing the high velocity power stream to diffuse and reduce in pressure until it has reduced in velocity.

The result of the above is reduced cavitation and turbulence in the mixing tube, reduced mixing tube wear, improved flow of the power fluid, better energy transfer, higher output pressure and higher output volume therefore increased efficiency. (FIG. 6)

One inherent problem with all jet pumps designs used in oil production is wear from sand erosion. The differential velocities of the power fluid and the produced fluid create a condition where sand particles are spun at high radial velocities while at the same time being forced at high linear velocity toward the wall of the mixing tube. In some cases, this can reduce mixing tube life to hours. Although the above reduces the differential velocities and therefore the problem a further modification to conventional designs is possible.

Alternating the path of produced fluid and power fluid (FIG. 3, 4) and adjusting the area of each as required, results in sand particles being forced toward the centre of the mixing tube instead of outward toward the wall of the tube therefore reducing sand erosion. As sand particles are introduced to the boundary layer of high velocity flow they are deflected toward the centre of the mixing tube.

The current invention (in configuration a) allows for changes to the flow pattern by reversing the inlets for power fluid and produced fluid as shown in (FIG. 4).

The present invention embodies the following features:

(1) A jet pump design for use in oil and gas wells that operates more efficiently, uses less power fluid, and has an improved operational life.

(2) A jet pump design for producing fluid from an oil or gas well having a pump intake to direct power fluid into a mixing tube, a nozzle for directing produced fluid into a mixing tube, a mixing tube to combine and average the energy of the power fluid and the produced fluid, and a diffuser to lower fluid velocity and build pressure to allow the fluid to be pumped.

(3) A jet pump design that does not incorporate a conventional venturi gap.

(4) A jet pump design where the nozzle is positioned at zero distance into the mixing tube.

(5) A jet pump design that recovers the potential energy available due to inlet or well bore pressure.

(6) A jet pump design that allows higher return pressures.

(7) A jet Pump design with improved wear characteristics that reduces turbulence in the mixing tube therefore, and increases mixing tube life.

(8) A jet pump design where power fluid is restricted from perpendicular movement to the direction of flow by the wall of the mixing tube. This results in reduced turbulence at the wall of the mixing tube, reduced or eliminated cavitation at the wall of the mixing tube therefore, increases mixing tube life, and improved efficiency.

(9) A jet pump design where sand present in the produced fluid stream is focused at the centre and away from the wall of the mixing tube. This results in reducing the effect of wear due to sand erosion at the mouth of the mixing tube.

(10) A jet pump design having the inverse configuration for introducing power fluid and produced fluid into the mixing tube and having a nozzle for directing power fluid into a mixing tube, a pump intake to direct produced fluid into a mixing tube, a mixing tube to combine and average the energy of the power fluid and the produced fluid, and a diffuser to lower exhaust fluid velocity and build pressure to allow the fluid to be pumped.

(11) A jet pump design that does not incorporate a conventional venturi gap.

(12) A jet pump design where the nozzle is positioned at zero distance into the mixing tube, or the venturi gap distance is reduced to zero.

(13) A jet pump design that directs produced fluid via a pump intake into the mixing tube at increased velocity and recovers the potential energy available due to inlet or well bore pressure.

(14) A jet pump design that introduces produced fluid into the mixing tube at higher velocity in the direction of flow therefore allows higher return pressures.

(15) A jet Pump design with improved wear characteristics that: reduces turbulence in the mixing tube therefore, increases mixing tube life, and improves efficiency.

(16) A jet pump design where produced fluid is restricted from perpendicular movement to the direction of flow, by the wall of the mixing tube which therefore helps to hold the power fluid stream together over a longer distance. This results in reducing turbulence in the mixing tube therefore, increasing mixing tube life, and improving efficiency

(17) A jet pump design where the differential velocity between the power fluid and the produced fluid, at the inlet to the mixing tube, is reduced therefore: reducing the effect of wear at the mouth of the mixing tube, due to sand erosion when there is sand in the produced fluid stream, reducing turbulence in the mixing tube therefore, increasing mixing tube life, and improving efficiency.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A jet pump for use with a wellbore having a tubing string therein so as to define a first passage and a second passage extending along the wellbore in which the first passage receives a working fluid pumped downwardly therethrough and the second passage receives produced fluids with the working fluid returning upwardly therethrough, the jet pump comprising:

a pump body having a main passage formed therein to extend upwardly from an inlet port at a periphery of the pump body at a bottom end of the main passage to a central outlet which is centrally located within the pump body at a top end of the main passage;

the main passage including an intake section at the bottom end of the main passage in communication with the inlet port, a mixing section extending upwardly from the intake section, and a diffuser section extending upwardly from the mixing section to the central outlet;

a nozzle body received within the pump body at a central axis of the pump body within the intake section of the main passage, the nozzle body defining a nozzle passage therein which tapers upwardly towards a nozzle opening in communication with the mixing section of the main passage thereabove;

the intake section being defined between a surrounding portion of the pump body and the nozzle body so as to extend upwardly from the inlet port up to an upper end of the intake section at the nozzle opening;

the mixing section being located above the nozzle opening so as to receive an upward flow of fluid from each of the nozzle passage and the intake section of the main passage;

the diffuser section extending upwardly while gradually increasing in cross sectional area towards the central outlet;

a bypass conduit extending alongside the main passage from a top end of the pump body to a bottom end of the pump body;

a top end of the bypass conduit arranged for communication with the first passage to receive the working fluid pumped downwardly therethrough;

a first one of the inlet port and the nozzle passage being in communication with the bottom end of the bypass conduit so as to receive the working fluid from the bypass conduit upwardly therethrough; and a second one of the inlet port and the nozzle passage being in communication externally of the wellbore to receive the produced fluids from the wellbore upwardly therethrough;

whereby the produced fluids and the working fluid are mixed in the mixing section of the main passage above the nozzle opening prior to exiting the central outlet of the pump body for returning up the second passage.

2. The jet pump according to claim 1 wherein the mixing section includes a lower portion extending upwardly from the nozzle opening and an upper portion above the lower portion, the upper portion having a constant cross sectional area extending upwardly along a length thereof and the lower portion reducing in cross sectional area while extending upwardly above the nozzle opening such that the upper and lower portions have matching cross sectional areas at a junction of the upper and lower portions.

3. The jet pump according to claim 1 wherein the nozzle opening is located at a junction of the intake section and the mixing section such that a longitudinal distance between the mixing section and the nozzle opening is zero.

4. The jet pump according to claim 1 wherein the inlet port is in communication externally of the pump body for receiving the produced fluids therein and the bottom end of the bypass conduit is in communication with the nozzle passage, such that the working fluid is directed upwardly through the nozzle passage while the produced fluids enter the inlet port.

5. The jet pump according to claim 4 wherein the nozzle passage is reduced in cross sectional area up to the nozzle opening.

6. The jet pump according to claim 4 wherein the intake section is gradually reduced in cross-sectional area while extending upwardly from the inlet port up to an upper end of the intake section at the nozzle opening.

7. The jet pump according to claim 1 wherein the nozzle passage is in communication externally of the pump body for receiving the produced fluids therein and the bottom end of the bypass conduit is in communication with the inlet port, such that the working fluid is directed upwardly through the intake section of the main passage while the produced fluids enter the nozzle passage.

8. The jet pump according to claim 7 wherein the intake section is gradually reduced in cross sectional area while extending upwardly from the inlet port up to an upper end of the intake section at the nozzle opening.

9. The jet pump according to claim 7 wherein the nozzle passage includes a tapering section which extends upwardly while being gradually reduced in cross sectional area at a location below the nozzle opening.

10. The jet pump according to claim 7 wherein the nozzle passage includes a constant section which extends upwardly from the tapering section to the nozzle opening having a constant cross sectional area.

11. The jet pump according to claim 1 in combination with the tubing string within the wellbore in which the pump body is suspended from the tubing string and in which the tubing string defines the first passage and the second passage therein such that one of the passages is annular in shape about the other passage such that the first and second passages are coaxial with one another along a length of the tubing string.

12. The jet pump according to claim 1 in combination with the tubing string within the wellbore in which the pump body is suspended from the tubing string and in which the tubing string defines the first passage and the second passage therein such that the first and second passages are parallel and alongside one another along a length of the tubing string.

13. The jet pump according to claim 1 in combination with the tubing string suspending the pump body thereon within the wellbore and an annular sealing packer assembly spanning an annular gap between the pump body and the wellbore to isolate an annular passage between the tubing string and the wellbore along a length of the tubing string wherein one of the first and second passages is defined within the tubing string and another one of the first and second passages is defined within said annular passage.

* * * * *